US006033498A

United States Patent [19]

Chen et al.

[11] Patent Number: 6,033,498

[45] Date of Patent: Mar. 7, 2000

[54] THERMAL PROCESSING OF NICKEL ALUMINIDE ALLOYS TO IMPROVE MECHANICAL PROPERTIES

[75] Inventors: Chien-Hua Chen, Anniston; Guy Monroe Maddox, Jr., Oxford; John Edward Orth; Elliott Lee Turbeville, both of Anniston, all of Ala.

[73] Assignee: United Defense, L.P., Arlington, Va.

[21] Appl. No.: 08/920,449

[22] Filed: Aug. 29, 1997

[51] Int. Cl.[7] ..... C22F 1/10

[52] U.S. Cl. ..... 148/555; 148/675

[58] Field of Search ..... 148/555, 675

[56] References Cited

U.S. PATENT DOCUMENTS 5,059,257 10/1991 Wanner et al. ..... 148/607

OTHER PUBLICATIONS

"High Temperature Performance of Nickel Aluminide Castings for Furnace Fixtures and Components", J.E. Orth and V.K. Sikka; pre–publication print from the 1996 Heat Treat Conference & Expo, sponsored by ASM International.

"Evaluation of the $Ni_3Al$ Base Alloys IC221 and IC218LZr", Samuelsson, P.W. Keefe, Special Metals Corporation, New Hartford, NY, R.W. Furgason, Ladish Comapny, Cudahy, WI, *Superalloys*, 1992.

*Primary Examiner*—Prince Willis

*Assistant Examiner*—Andrew L. Oltmans

*Attorney, Agent, or Firm*—Ronald C. Kamp

[57] ABSTRACT

Castings based on the nickel aluminide intermetallic alloy IC-221M were melted and poured with an addition of enough molybdenum to bring its concentration to 5 weight %. This resulted in a minimization or elimination of the nickel-zirconium eutectic phase in the dies machined and prepared from these castings. The benefit of eliminating or minimizing the nickel zirconium eutectic phase with the addition of measurable amounts of molybdenum (Mo) to the nickel aluminide ($Ni_3Al$) alloy is the increase in the useful service life of the tooling made from it; thus providing the advantages of increased productivity, enhanced quality and reduced costs in a manufacturing setting. Heat treatment of the dies machined and prepared from these castings was also undertaken. The heat treatment regimen includes solution treatment at 2100° F. for 24 hours and aging from between 1150° F. and 1300° F. for between 12 to 24 hours. The benefit of heat treating the dies is the increase in the mechanical properties and hence the service life of the tooling made from it.

5 Claims, 6 Drawing Sheets

IC221M CRACK THRU EUTECTIC NETWORK 100X

IC221M CRACK THRU EUTECTIC NETWORK 100X

| ELEMENTS | WEIGHT PERCENT IN $Ni_3Al$ ALLOY IC-221M | WEIGHT PERCENT IN ALLOY IC-221M MODIFIED WITH 5% Mo |
|---|---|---|
| NICKEL | BALANCE | BALANCE |
| CHROMIUM | 7.70 | 7.91 |
| MOLYBDENUM | 1.43 | 5.00 |
| ALUMINUM | 8.00 | 8.16 |
| BORON | 0.008 | 0.012 |
| ZIRCONIUM | 1.70 | 1.33 |

| PROPERTIES | $Ni_3Al$ ALLOY IC-221M | ALLOY IC-221M MODIFIED WITH 5% Mo |
|---|---|---|
| TENSILE STRENGTH, PSI | 85,800 | 91,000 |
| ELONGATION, % | 6.5 | 7.0 |
| BRINELL HARDNESS | 270 | 269 |

| ELEMENTS | WEIGHT PERCENT IN $Ni_3Al$ ALLOY IC-221M | WEIGHT PERCENT IN $Ni_3Al$ ALLOY IC-221M MODIFIED TO 4% Mo | WEIGHT PERCENT IN $Ni_3Al$ ALLOY IC-221M MODIFIED TO 5% Mo |
|---|---|---|---|
| NICKEL | BALANCE | BALANCE | BALANCE |
| CHROMIUM | 7.70 | 7.95 | 7.91 |
| MOLYBDENUM | 1.43 | 3.92 | 5.00 |
| ALUMINUM | 8.00 | 8.57 | 8.16 |
| BORON | 0.008 | 0.007 | 0.012 |
| ZIRCONIUM | 1.70 | 1.67 | 1.33 |

FIG. 6

| MATERIALS | YIELD STRENGTH PSI | TENSILE STRENGTH PSI | ELONGATION % | BRINELL HARDNESS NUMBER |
|---|---|---|---|---|
| IC-221M | 72,211 | 85,800 | 6 | 270 |
| IC-221M + 4%MO | 80,600 | 91 ,000 | 5 | 294 |
| IC-221M + 4%MO AFTER HEAT TREAT | 74,100 | 88 ,400 | 7 | 269 |
| IC-221M + 5%MO | 83,720 | 91,000 | 7 | 285 |
| IC-221M + 5%MO AFTER SOLUTION TREAT, 2100¡F FOR 24 HOURS | 91,000 | 118,300 | >10 | 302 |
| IC-221M + 5%MO SOLUTION TREAT, 2100¡F FOR 24 HOURS & AGING AT 1200¡F FOR 24 HOURS | 93,600 | 119,600 | 13 | 341 |
| IC-221M + 5%MO SOLUTION TREAT, 2100¡F FOR 24 HOURS & AGING AT 1250¡F FOR 12 HOURS | 104,000 | 117,000 | 9 | 341 |
| IC-221M + 5%MO SOLUTION TREAT, 2100¡F FOR 24 HOURS & AGING AT 1150¡F FOR 12 HOURS | 93,600 | 111,800 | 9 | 321 |
| IC-221M + 5%MO SOLUTION TREAT, 2100¡F FOR 24 HOURS & AGING AT 1300¡F FOR 12 HOURS | 106,600 | 113,100 | 5 | 363 |

FIG. 7

THERMAL PROCESSING OF NICKEL ALUMINIDE ALLOYS TO IMPROVE MECHANICAL PROPERTIES

BACKGROUND OF THE INVENTION

1. Field of the Invention

This invention has to do with nickel aluminide intermetallic alloys for metal-forming tooling applications which take advantage of the high temperature strength and wear resistance of these alloys. Specifically, this invention is directed to the elimination or minimization of the nickel zirconium eutectic phase in the cast or wrought tooling through the addition of measurable amounts of molybdenum (Mo) to the nickel aluminide ($Ni_3Al$) alloy in order to increase the useful service life of the tooling made from it; thus providing the advantages of increased productivity, enhanced quality and reduced costs in a manufacturing set up.

Also, this invention has to do with the heat treatment or thermal processing of nickel aluminide ($Ni_3Al$) intermetallic alloys for use in high temperature applications and tooling for open and closed die forging where high strengths and hardnesses are required but without sacrifice of ductility in order to improve lifetimes of the tooling made from these alloys.

2. Description of the Prior Art

For about ten years, substantial efforts have been devoted to research and development of ordered intermetallics. Ordered intermetallic compounds constitute a unique class of metallic materials that form a long range, ordered crystal structure below a critical temperature, generally referred to as the critical ordering temperature (Tc). These ordered intermetallics usually exist in relatively narrow compositional ranges around simple stoichiometric ratios. Significant progress has been made in understanding their susceptibility to brittle fracture and in improving ductility and toughness of $Ni_3Al$ at both low and high temperatures. In a number of cases, significant tensile ductility has been achieved at ambient temperatures by controlling ordered crystal structures, increasing deformation modes, enhancing bulk and grain-boundary cohesive strengths, and controlling surface composition and test environments. Success in these areas has inspired parallel efforts aimed at improving mechanical strength properties. The attempts for practical usage of intermetallics were first realized in the field of "functional materials" such as magnetic materials, semiconductor materials and superconducting materials. However, as far as their usage as structural engineering materials is concerned, the intermetallics were completely ignored because of their extreme brittleness and poor ductility. The discovery of the ductilizing effect that boron has on the alloy has led to the expectations for practical usage of the intermetallics as heat resistant materials. The nickel aluminide ($Ni_3Al$) of interest in the instant invention has potential as high temperature engineering materials due to its tendency to increase in yield strength and tensile strength with an increase in test temperature.

The alloy design work has been centered primarily on aluminides of nickel, iron and titanium and this work has resulted in substantial improvements in the mechanical and metallurgical properties of these materials at ambient and elevated temperatures. Of particular interest to the instant invention are the aluminides based on nickel which have had to be engineered to overcome ductility problems namely brittle cracking and crazing in order to be ready for structural applications. It has been the perception in the industry that nickel aluminides are so brittle the compounds simply cannot be fabricated into useful structural components. Even when fabricated, these compounds have a low fracture toughness that severely limits their use as engineering materials. The study of the ductility and strength of $Ni_3Al$ has led to the development of ductile nickel aluminide alloys for structural applications. According to a review article by Oak Ridge National Laboratory scientists, the alloys generally contained hafnium, zirconium, tantalum, and molybdenum at levels up to 8 weight % for improving strength at elevated temperatures. The starting nickel aluminide alloy IC-221M for the instant invention was developed by researchers at Oak Ridge National Laboratories (ORNL) with controlled additions of chromium (Cr), molybdenum (Mo), zirconium (Zr), and boron (B). Both the boron and chromium additions improved the intermediate ductility at room and high temperatures. Molybdenum improved the room and high temperature strength. Zirconium improved high temperature strength, oxide spallation resistance, weldability, and castability. The alloys generally contain zirconium and molybdenum at levels up to 8 weight % for improving strength at elevated temperatures. They contain up to 10 weight % chromium for enhancing ductility at intermediate temperatures of 750° F. to 1650° F. Boron at levels of 0.01 weight % or less is added for strengthening grain boundaries and increasing ductility at ambient temperature.

Several patents related to these structures have been allowed. They are listed below.

Reexamination Certificate issued Jul. 23, 1997 for U.S. Pat. No. 4,612,165, Ductile Aluminide Alloys for High Temperature Applications.

U.S. Pat. No. 4,731,221, Nickel Aluminides and Nickel-Iron Aluminides for Use in Oxidizing Environments.

U.S. Pat. No. 5,006,308, Nickel Aluminide Alloy for High Temperature Structural Use.

U.S. Pat. No. 5,108,700, Castable Nickel Aluminide Alloys for Structural Applications U.S. Pat. No. 4,711,761, Ductile Aluminide Alloys for High Temperature Applications.

Researchers at the Institute of Aeronautical Materials in Beijing, China have also developed a castable nickel aluminide ($Ni_3Al$) intermetallic alloy. The nominal composition of this alloy is 14 weight % molybdenum and 0.03 to 0.15 weight % boron. Because the alloy was developed for applications in fail-safe environments like gas turbine blades and air transport vanes, this alloy was required to have yield strengths in the vicinity of 120,000 psi, tensile strengths in the vicinity of 183,000 psi and was not allowed to have any measurable amount of zirconium so as to prevent the formation of the nickel-zirconium eutectic phase. Heat checking and cracking occurs in this phase with the resultant failure of the component.

These alloys were limited in their usefulness to the manufacturing and commercial products markets because of a lack of experience and willingness to melt and cast the high aluminum contents found in these nickel aluminides. Using ORNL's "exothermic melt process" and the nickel aluminide alloy IC-221M, successful melt and pour of commercial-sized heats up to 8,000 pounds have been accomplished. However, the forging dies that were cast from these heats were limited in their useful life due to heat checking, thermal fatigue, and cracking of the die material. This heat checking and cracking arose from the nickel zirconium eutectic phase formed between the zirconium, added for improved castability, and the nickel in the nickel aluminide alloy IC-221M. The surface cracks propagated from the surface of the die into the bulk of the die material, negatively impacting the useful life of the die material and causing the work piece to stick to the die surface and in the die cavity. This slows production and leads to the scrapping of the workpiece because of surface indications. As the extent of the heat checking and cracking increased, more time in the die repair shop had to be spent polishing and grinding dies. Upon resink of the die, substantially greater amounts of the die material must be removed before the die can be returned to service. If the heat checking and cracking are severe enough, severe mechanical fatigue and die breakage will occur. The quantity of pieces that could be realized on the die is shorted, as well as, the uptime on the press itself. The higher costs associated with the heat checking and cracking problem on these dies come from higher maintenance requirements of polishing and grinding dies in the press, die breakage, lower production, higher scrap, die material loss, elevated sinking times, and less pieces per die. Consequently, increased productivity, enhanced quality and cost savings in a manufacturing setting were the drivers for the instant invention.

Researchers at Special Metals Corporation and Ladish Company have published their work on the effects of heat treating the nickel aluminide alloy IC-221M for 12 hours at 1204° F. to 2200° F. on the microstructural features in the eutectic phase and the gamma phase. Specifically, the changes of interest were the point at which the gamma phase started to coarsen and where the eutectic phase started to grow. They sought to demonstrate that $Ni_3Al$ base alloys can be consumably remelted into production-size ingots without deleterious segregation or ingot cracking. This aforementioned work does not anticipate the instant invention where the mechanical properties of the nickel aluminide alloy IC-221M are increased through heat treatment to improve the alloy's performance in tooling and other structural applications.

In our search of the prior art, we found six articles of note. Their citations follow.

Liu, C. T., Stiegler, J. O. and Froes, F. H. "Ordered Intermetallics", Volume 2, *ASM Metals Handbook*, October, 1990, ASM International.

Han, Y. F., Li, S. H., Ma, S., Tan, Y. N. and Chaturvedi, M. C., "A DS Casting $Ni_3Al$ Base Superalloy for Gas Turbine Blades and Vanes", *The First Pacific Rim International Conference on Advanced Materials and Processing,* 1992.

Izumi, O., "Intermetallic Compounds as Engineering Materials", *The First Pacific Rim International Conference on Advanced Materials and Processing,* 1992.

Orth, J. E., Sikka, V. K., "Commercial Casting of Nickel Aluminide Alloys", *Advanced Materials & Processes*, November, 1995.

Samuelsson, E., Keefe, P. W. and Furgason, R. W., "Evaluation of the $Ni_3Al$ Base Alloys IC221 and IC218LZr", *Superalloys,* 1992.

Orth, J. E. and Sikka, V. K., "High Temperature Performance of Nickel Aluminide Castings for Furnace Fixtures and Components", 1996 *Heat Treat Conference & Exposition*, ASM International.

SUMMARY OF THE INVENTION

An object of the invention is to increase the life and performance of nickel aluminide intermetallic tooling through the minimization of the nickel-zirconium eutectic phase in the cast or wrought tooling for closed die forging, open die forging, isothermal forging, superplastic forging, permanent mold casting and die casting. The tooling used in these forging operations can be hammer die inserts, press dies or inserts, extrusion dies, open press dies, permanent mold dies, reducer roll dies and diecast dies, utilizing presses or hammers which may be mechanical, hydraulic or screw driven and representative of hot, warm or cold forming operations.

Another object of the invention is to increase the as-cast mechanical properties of yield strength, tensile strength and hardness of the ORNL-licensed nickel aluminide alloy IC-221M, without sacrificing ductility, in order to increase die life and performance of dies cast from it for closed die forging, open die forging and extrusion tooling.

Initially, brake spider buster dies were chosen as candidates for nickel aluminide tooling. Most of the energy generated by the mechanical press in this first operation goes into the deformation of the workpiece, instead of more of that available energy being absorbed as added stresses in the dies. Due to the high volume of parts which are run on this particular job, this application would give some quick data as to the performance of nickel aluminide as a die material. These buster dies were manufactured complete, instead of die inserts, because of part size limitations, material ductility concerns, and machining concerns. The dies were sunk using conventional milling and ram electrodischarge machining (EDM). Experiences gained from using the unmodified nickel aluminide alloy IC-221M for use as forge tooling showed the heat checking and cracking of the surface as the life limiting factor. Using optical microscopy techniques, the microstructure of this nickel aluminide intermetallic alloy was examined. As-cast structures, representative of the die before it is placed in service, and samples removed from used forging dies were examined. This work identified that heat checking and cracking only occurs in the nickel-zirconium eutectic phase. Cracks initiate and propagate through the eutectic phase and are blunted at the gamma grain boundaries.

The chemistry of nickel aluminide alloy IC-221M, which contains 1.43 weight % molybdenum, was modified in this embodiment by the addition of enough molybdenum (Mo) to bring the composition to 5 weight % Mo. The objective was to evaluate the effect of an increased molybdenum content on the formation of the nickel-zirconium eutectic phase. It is anticipated that the increased Mo content would also produce a harder and stronger die material without sacrificing ductility as measured by percent elongation. Test data on tensile specimens per ASTM A370 comparing the tensile strength and percent elongation between the as-cast unmodified IC-221M and the IC-221M with the 5% Mo showed an unexpectedly good result of 6 to 7% increase in strength and ductility measures. Also an unexpectedly good result was the fact that these increases in strength and ductility measures were accomplished without any increase in hardness of the die material. Furthermore, 8,800 pieces were run on the die cast from the nickel aluminide alloy IC-221M modified to 5% molybdenum before noticeable heat cracking and heat checking occurred as opposed to only 1,000 pieces die run on the basic nickel aluminide alloy IC-221M.

Near net shapes of nickel aluminide alloy IC-221M have been repeatedly cast as die blocks. The die blocks performed unevenly with some performing well and others not performing as well. The intended applications of closed and open die forging as well as extrusion tooling require moderate to high hardnesses and yield strength in order to maintain die impressions for a substantial lifetime without the need for retooling or reshaping. Increasing the mechanical properties of the nickel aluminide alloy IC-221M through heat treatment will improve the alloy's performance in tooling and other structural applications.

BRIEF DESCRIPTION OF THE DRAWINGS

FIG. 6 compares the chemistry of the unmodified nickel aluminide alloy IC-221M with that of the IC-221M modified so as to have a composition of 4 weight % molybdenum and 5 weight % molybdenum.

FIG. 7 is a tabulation of the yield strength, tensile strength, percent elongation, percent reduction in area and Brinell hardness of the as cast nickel aluminide alloy IC-221M, IC-221M modified with 4% molybdenum (Mo) before and after heat treatment and IC-221M modified with 5% molybdenum (Mo) after heat treating and aging at different times and temperatures.

DESCRIPTION OF THE PREFERRED EMBODIMENT

Figure 1:
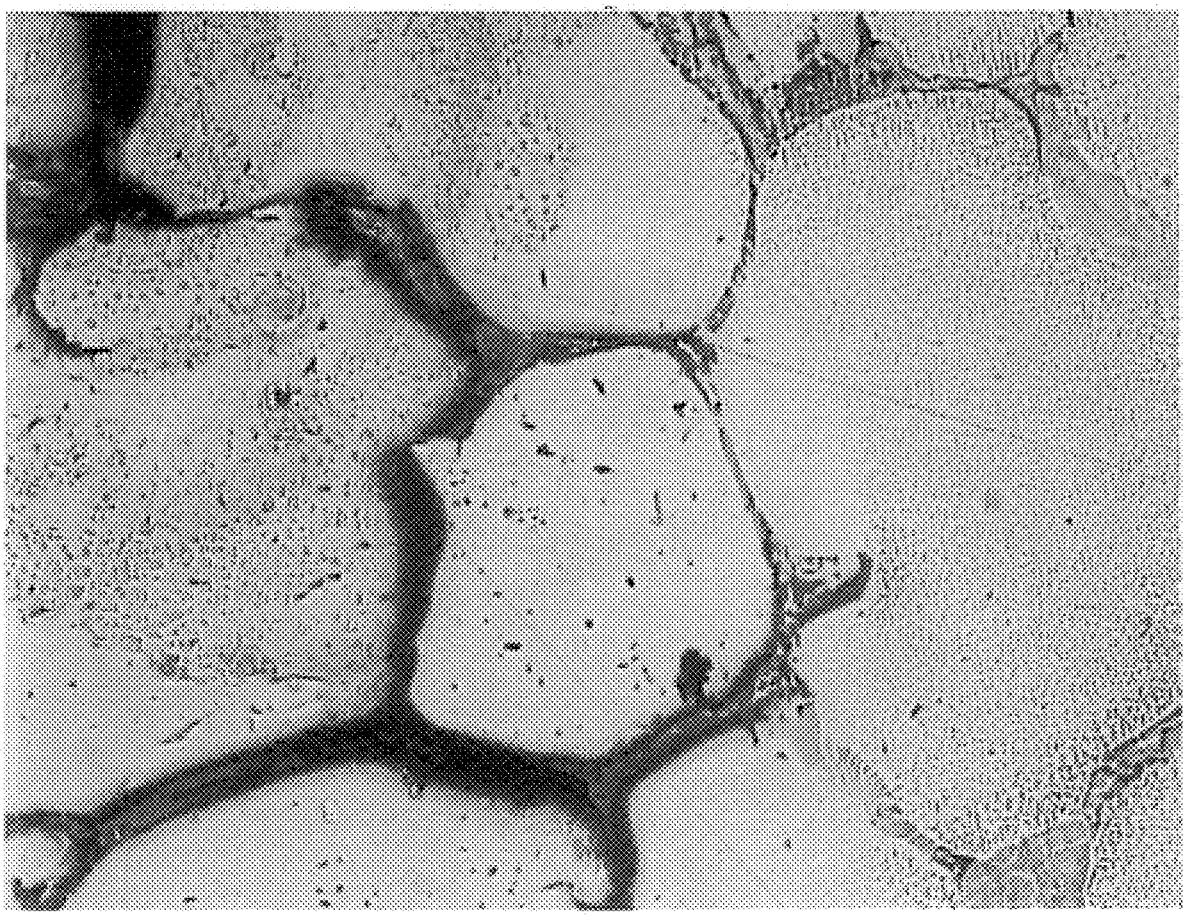
FIG. 1 is a photomicrograph of the as-cast unmodified nickel aluminide alloy IC-221M showing the heat checking and cracking in the nickel zirconium eutectic phase.

The instant invention was intended to solve two problems concerning $Ni_3Al$ as a forging die material. The goals were to reduce or eliminate heat checking and heat cracking of the forging die and to improve the tensile strength and percent elongation of the as-cast material itself. The source of the heat checking or thermal fatigue has been identified as the nickel-zirconium eutectic phase present in the $Ni_3Al$ alloy IC-221M. The microstructure of nickel aluminide intermetallic alloy IC-221M was examined using optical microscopy techniques. As-cast structures, representative of the die before it is placed in service, and samples removed from used forging dies were examined. This work identified that heat checking and cracking only occurs in the nickel-zirconium eutectic phase as shown in FIG. 1. Cracks initiate and propagate through the eutectic phase and are blunted at the gamma grain boundaries. Scanning electron microscopy was used to identify the primary constituents of the eutectic phase as nickel and zirconium.

Surface cracks, resulting from heat checking, propagate from the surface of the die into the bulk of the die material. Not only does this negatively impact the useful life of the die material, it also causes the work piece to stick to the die surface and in the die cavity, thus slowing production and causing the workpiece to be scrapped because of surface indications. As the extent of the heat checking and cracking increases, more time must be spent polishing and grinding dies, and upon resink of the die, substantially greater amounts of the die material must be removed before the die can be returned to service. If the heat checking and cracking are severe enough, die breakage will result.

Figures 2, 3:
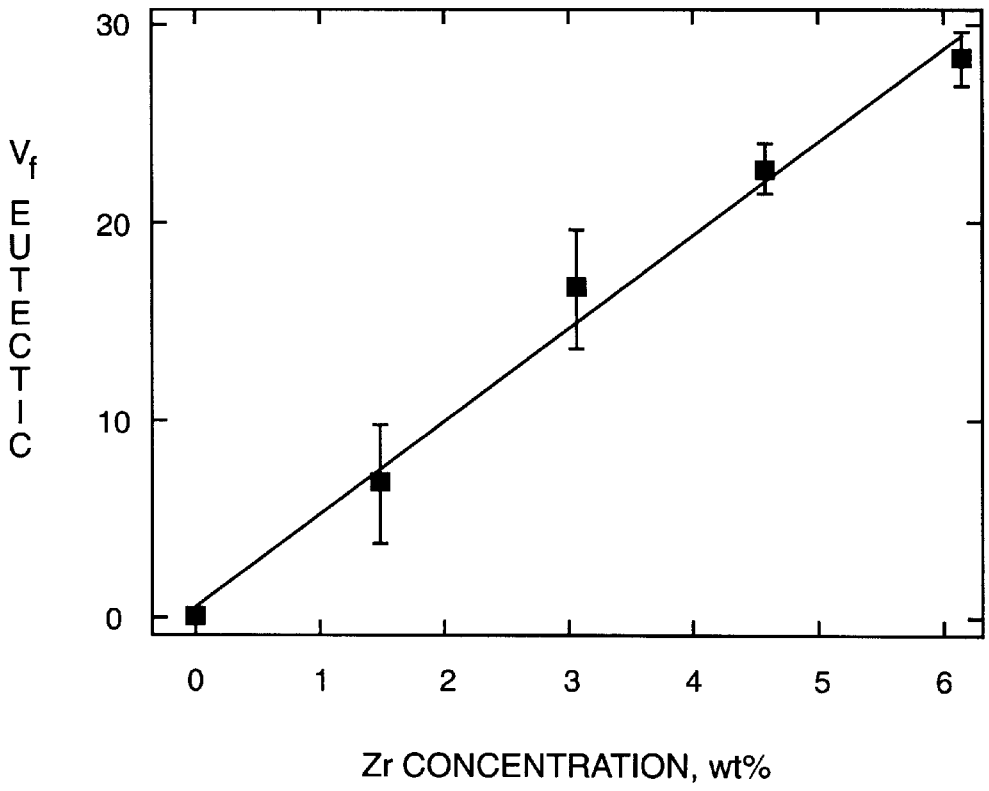
FIG. 2 compares the chemistry of the unmodified nickel aluminide alloy IC-221M with that of the IC-221M modified so as to have a composition of 5 weight % molybdenum.
FIG. 3 is a graph showing the dependency of the amount of the nickel-zirconium eutectic on the weight % of zirconium.

FIG. 2 compares the chemistry of the unmodified nickel aluminide alloy IC-221M with that of the IC-221M modified with enough molybdenum to bring its compostion to 5 weight % Mo. It is known that molybdenum retards the formation of the nickel-zirconium eutectic phase that is the origin of the heat cracking problem. This is shown graphically as a decrease in the volume fraction % of the nickel-zirconium eutectic phase as a function of the zirconiun concentration in FIG. 3. It is the ordered microstructure of nickel aluminide alloy IC-221M that provides thermal stability at high temperatures. This alloy consists of fine gamma' precipitates in a gamma matrix and a small fraction of nickel-zirconium eutectic at grain boundaries. Metallurgical observations from the die surface and near surface for the IC-221M buster die, as described below, revealed some slight coarsening of the gamma' phase, spherodizing of the eutectic phase and blunting at the gamma grain boundaries of any surface cracks or heat checking. The heat checking and cracking problems in the die are further mitigated or eliminated by the decrease in the nickel-zirconium eutectic, thereby prolonging die life and press uptime.

Figures 4, 5:
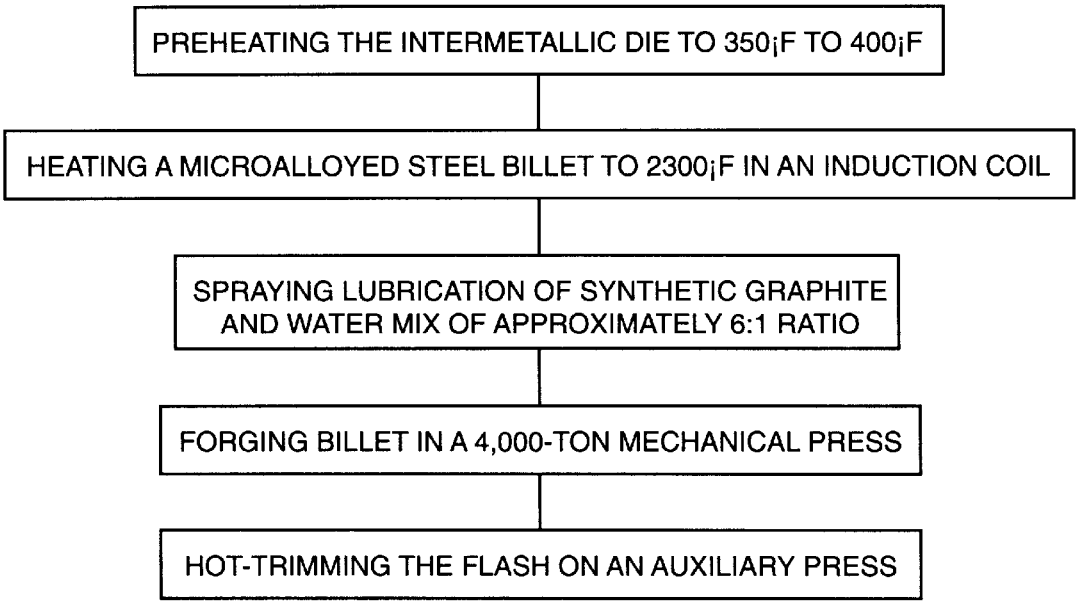
FIG. 4 is the process flow chart for the melting and casting of the nickel aluminide alloy IC-221M buster die on a brake spider forging.
FIG. 5 compares the tensile strength and ductility, percent elongation, of the unmodified nickel aluminide alloy IC-221M with that of the IC-221M modified with 5% molybdenum.

FIG. 4 is the process flow chart for the melting and casting of the nickel aluminide alloy IC-221M buster die on a brake spider forging. The first application testing dies made from as-cast nickel aluminide alloy IC-221M was as buster dies on a brake spider forging. The typical die life for this part when using conventional hot-work die steels is 5,000 pieces per set and the mode of failure is rapid die erosion. Forging was conducted in a 4,000 Ton mechanical press with a production rate of 150 pieces/hour. The dies are preheated to 350 to 500° F. The process for the brake spider forging requires heating a 0.30 carbon microalloyed billet from 2250° F. and 2350° F., preferably to 2300° F., in an induction coil. Sprayed lubrication for material flow and die cooling is a synthetic graphite and water mix of approximately 6:1 ratio. The billet is fed to the first of three closed-die impression stations, the buster. The billet is placed on the buster die. Once the press is cycled, it distributes the material evenly within the die, filling the die properly without defects. The work piece is then fed to the blocker die, which further refines the part and is close to the size of the finisher die and then to the finish dies which produce the finish part dimensions. The flash is hot trimmed on an auxiliary press.

FIG. 5 compares the tensile strength and ductility, percent elongation, of the unmodified nickel aluminide alloy IC-221M with that of the IC-221M modified with 5% molybdenum. The increased molybdenum content produced a harder and stronger die material without sacrificing ductility as measured by percent elongation. Test data on tensile specimens per ASTM A370 comparing the tensile strength and percent elongation between the as-cast unmodified IC-221M and the IC-221M with the 5% molybdenum showed a 6 to 7% increase in strength and ductility measures. An unexpectedly good result was that these increases were accomplished without any attendant effects on the hardness of the die material. Although the addition of enough molybdenum to bring the composition to 5 weight % Mo is the preferred embodiment, it is expected that the addition of up to 8% molybdenum will show similar efficacious results.

FIG. 6 compares the chemistry of the unmodified nickel aluminide alloy IC-221M with that of the IC-221M modified so as to have a composition of 4 weight % molybdenum and 5 weight % molybdenum. FIG. 7 is a tabulation of the yield strength, tensile strength, percent elongation, percent reduction in area and Brinell hardness of the as cast nickel aluminide alloy IC-221M, IC-221M modified with 4% molybdenum (Mo) before and after heat treatment and IC-221M modified with 5% molybdenum (Mo) after heat treating and aging at different times and temperatures. The heat treatment regimen follows:

Solution treatment at 2100° F. for 24 hours. Solution treatment is heating a metallic alloy to a high enough temperature such that all extraneous phases such as carbides are dissolved in the major phase.

Solution treatment at 2100° F. for 24 hours and aging at 1200° F. for 24 hours.

Solution treatment at 2100° F. for 24 hours and aging at 1250° F. for 12 hours.

Solution treatment at 2100° F. for 24 hours and aging at 1150° F. for 12 hours

Solution treatment at 2100° F. for 24 hours and aging at 1300° F. for 12 hours.

Figure 8:
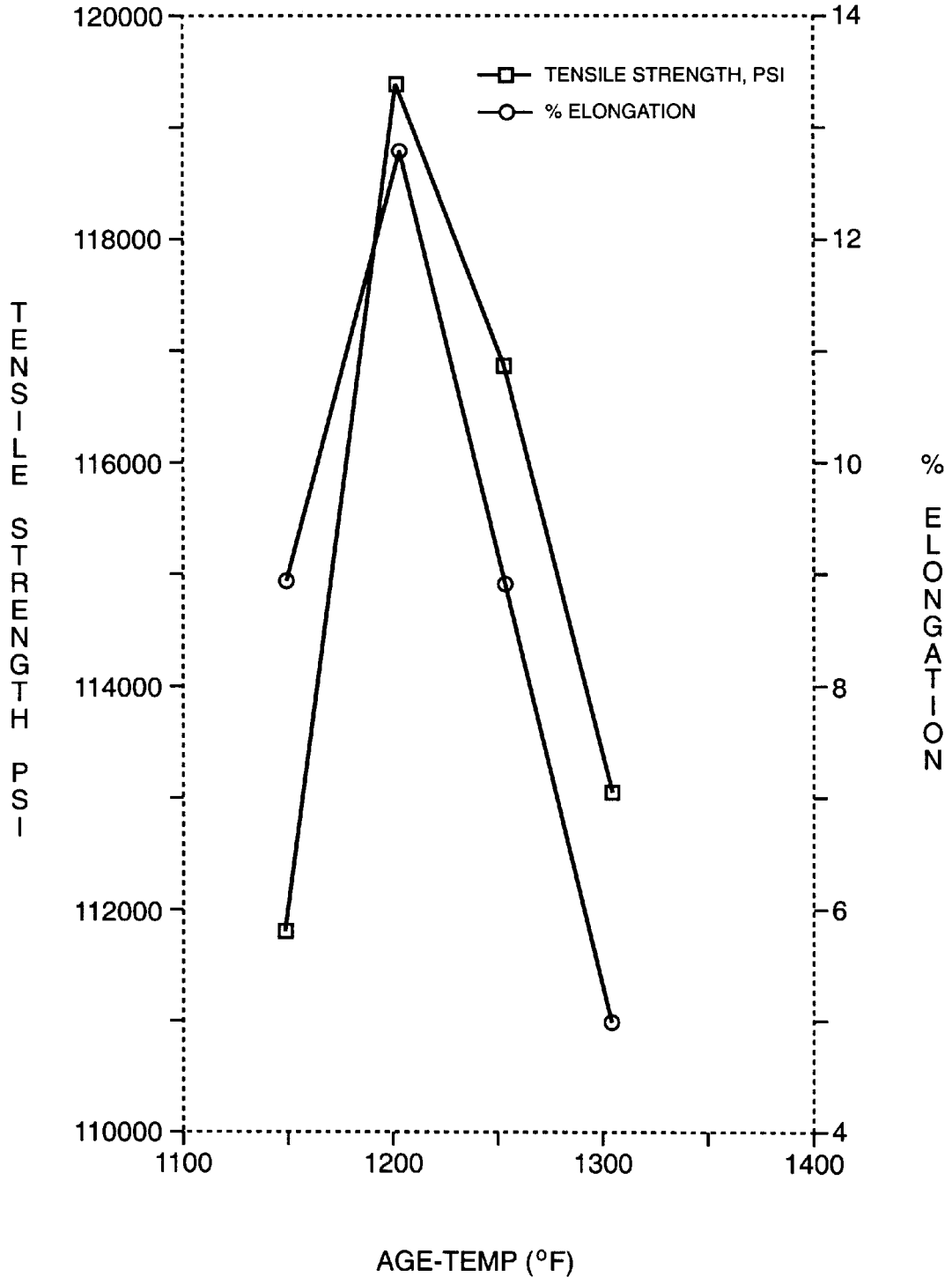
FIG. 8 is a graph of tensile strength and percent elongation versus aging temperature after the heat treatment regimen.

Heat treatment of the nickel aluminide alloy IC-221M modified so as to have a composition of 4% molybdenum leads to a decrease rather than an increase in mechanical properties. This is unlike the strengthening of mechanical properties observed after heat treatment of the nickel aluminide alloy IC-221M modified with enough molybdenum to result in a composition of 5 weight % Mo. The average as cast hardness of the nickel aluminide alloy IC-221M modified so as to have a compostion of 5 weight % molybdenum is 285 HBN (Hardness Brinell Number). Solution annealing the nickel aluminide above 2000° F. has shown a significant increase in hardness, yield strength and tensile strength. Average hardness after various times and various temperatures between 2000° F. and 2200° F. has increased to 325 HBN. Maximum values observed are 341 HBN and minimum values are 302 HBN. The data in FIG. 7 show the average hardness increasing even more after aging between 1000° F. and 1400° F. in 50° F. increments for 12 to 24 hours. Maximum observed hardness is 363 HBN and the minimum is 302 HBN. The average hardness after various combinations of aging times and temperatures is 330 HBN. The average yield and tensile strength for the as cast nickel aluminide alloy IC-221M are 72,000 psi and 86,000 psi, respectively. The average yield and tensile strength for the as cast nickel aluminide alloy IC-221M modified with 5% molybdenum are 83,700 psi and 91,000 psi, respectively. After solution annealing, the values increased to 91,000 psi and 118,000 psi. Aging at various temperatures has brought the averages up to 98,000 psi and 113,000 psi. Maximum values recorded for yield strength and tensile strength are 106,000 psi and 119,500 psi. Over the aging temperature range, unexpectedly good results occur where both the ductility measure of percent elongation and the tensile strength increase at lower aging temperatures and peak at the aging temperature of 1200° F., as shown in FIG. 8.

In summary, in a simple embodiment of the invention, melting and casting of the 5% molybdenum-modified nickel aluminide alloy IC-221M buster die on a brake spider forging was undertaken. The effect of minimizing or eliminating the presence of the nickel-zirconium eutectic phase was evaluated. The benefit of eliminating or minimizing the nickel zirconium eutectic phase in the cast or wrought tooling with the addition of measurable amounts of molybdenum (Mo) to the nickel aluminide ($Ni_3Al$) alloy is to increase the useful service life of the tooling made from it; thus providing the advantages of increased productivity, enhanced quality and reduced costs in a manufacturing setting. Also, the effects of heat treating these dies were evaluated. The advantages of the resultant increase in the as-cast mechanical properties of yield strength, tensile strength and hardness of the nickel aluminide alloy IC-221M modified so as to have a compostion of 5 weight % molybdenum, without sacrificing ductility, was improved die life and performance of dies cast from it for closed die forging, open die forging and extrusion tooling.

The foregoing description, when read in conjunction with a perusal of the drawing figures, shows how the implementation of improved nickel aluminide intermetallic alloys for tooling applications and the heat treatment of the resulting dies can be and is used to meet the objects of the invention. The following claims seek to protect the inventor's idea by claiming the improvements to the nickel aluminide intermetallic alloys in a manner that captures the spirit of the invention. Minor deviations and nuances of the invention are contemplated as being covered by the following claims.

What is claimed is:

1. A method for increasing mechanical properties of the improved $Ni_3Al$ intermetallic alloys for use in a forging die, comprising the steps of:

providing a nickel aluminide intermetallic alloy charge;

melting said alloy charge to create a molten charge;

alloying said molten charge with an additional of enough molybdenum to bring its concentration to at least 4.5 weight % and no more than 5.5 weight % to create a modified molten charge;

casting a forging die from said modified molten charge;

heat treating said die as-cast to a minimum of 2100° F. and a maximum of 2282° F. for between 2 hours and 48 hours; and aging said as-cast heat treated die at a minimum of 1150° F. to a maximum of 1350° F. for 2 hours to 12 hours.

2. The method according to claim 1, wherein the step of alloying said molten charge brings the concentration of molybdenum to 5 weight %.

3. The method according to claim 1, wherein the nickel aluminide intermetallic alloy charge is IC-221M.

4. The method according to claim 1 wherein the said modified molten charge has between 7 weight % to 9 weight % chromium.

5. The method according to claim 1, wherein the said modified molten charge has between 0.005 weight % to 0.020 weight % boron.

* * * * *